United States Patent [19]

Katchka et al.

[11] Patent Number: 4,604,049

[45] Date of Patent: Aug. 5, 1986

[54] DUAL RATE BURNER CONSTRUCTION AND METHOD OF MAKING THE SAME

[75] Inventors: Jay R. Katchka, Cypress; Gilbert Schultz, Long Beach, both of Calif.

[73] Assignee: Robertshaw Controls Company, Richmond, Va.

[21] Appl. No.: 769,572

[22] Filed: Aug. 26, 1985

[51] Int. Cl.[4] ..... F23H 5/10

[52] U.S. Cl. ..... 431/80; 431/350

[58] Field of Search ..... 431/80, 172, 350, 347, 431/348

[56] References Cited

U.S. PATENT DOCUMENTS

| | | | |
|---|---|---|---|
| 3,754,853 | 8/1973 | Braucksiek et al. | 431/347 |
| 3,802,829 | 4/1974 | Morris | 431/347 |
| 3,998,582 | 12/1976 | Katchka et al. | 431/349 |

*Primary Examiner*—Carroll B. Dority, Jr.

*Attorney, Agent, or Firm*—Candor, Candor & Tassone

[57] ABSTRACT

A dual rate burner construction and method of making the same are provided, the dual rate burner construction comprising a burner housing having an inlet for receiving fuel from a source thereof and an outlet through which the fuel can issue to produce flames exterior to the burner housing when the issued fuel has been ignited, a flame spreader carried by the burner housing for spreading the flames into a desired heating pattern thereof for a heating purpose when the fuel is being directed into the inlet at a full rate of flow thereof and for directing the flames into a desired standby pattern thereof when the fuel is being directed into the inlet at a standby rate of flow thereof, and a flame sensing unit carried by the construction for detecting the presence of the flames, the flame sensing unit being carried by the flame spreader in a spaced relation to the burner housing.

20 Claims, 7 Drawing Figures

DUAL RATE BURNER CONSTRUCTION AND METHOD OF MAKING THE SAME

BACKGROUND OF THE INVENTION

1. Field of the Invention

This invention relates to a new dual rate burner construction and to a new method of making such a dual rate burner construction.

2. Prior Art Statement

It is known to provide a dual rate burner construction comprising a burner housing means having inlet means for receiving fuel from a source thereof and outlet means through which the fuel can issue to produce flame means exterior to the burner housing means when the issued fuel has been ignited, a flame spreader means carried by the burner housing means for spreading the flame means into a desired heating pattern thereof for a heating purpose when the fuel is being directed into the inlet means at a full rate of flow thereof and for directing the flame means into a desired standby pattern thereof when the fuel is being directed into the inlet means at a standby rate of flow thereof, and a flame sensing means carried by the construction for detecting the presence of the flame means. For example, see the U.S. Pat. No. to Katchka et al 3,998,582.

SUMMARY OF THE INVENTION

It is one feature of this invention to provide a new dual rate burner construction.

In particular, it was found according to the teachings of this invention that the flame sensing means of a dual rate burner construction could be uniquely carried by the flame spreader means thereof rather than by the burner housing means thereof and still function for the purpose of detecting the presence of the flames of the burner construction whether the burner construction is receiving fuel at a full rate of flow thereof or at a standby rate of flow thereof whereby it is believed that by so arranging the flame sensing means of the burner construction of this invention, the overall manufacturing operation is simplified as will be apparent hereinafter.

For example, one embodiment of this invention provides a dual rate burner construction comprising a burner housing means having inlet means for receiving fuel from a source thereof and outlet means through which the fuel can issue to produce flame means exterior to the burner housing means when the issued fuel has been ignited, a flame spreader means carried by the burner housing means for directing the flame means into a desired heating pattern thereof for a heating purpose when the fuel is being directed into the inlet means at a full rate of flow thereof and for directing the flame means into a desired standby pattern thereof when the fuel is being directed into the inlet means at a standby rate of flow thereof, and a flame sensing means carried by the construction for detecting the presence of the flame means, the flame sensing means being carried by the flame spreader means in a spaced relation to the burner housing means.

Accordingly, it is an object of this invention to provide a new dual rate burner construction having one or more of the novel features of this invention as set forth above or hereinafter shown or described.

Another object of this invention is to provide a new method of making such a dual rate burner construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
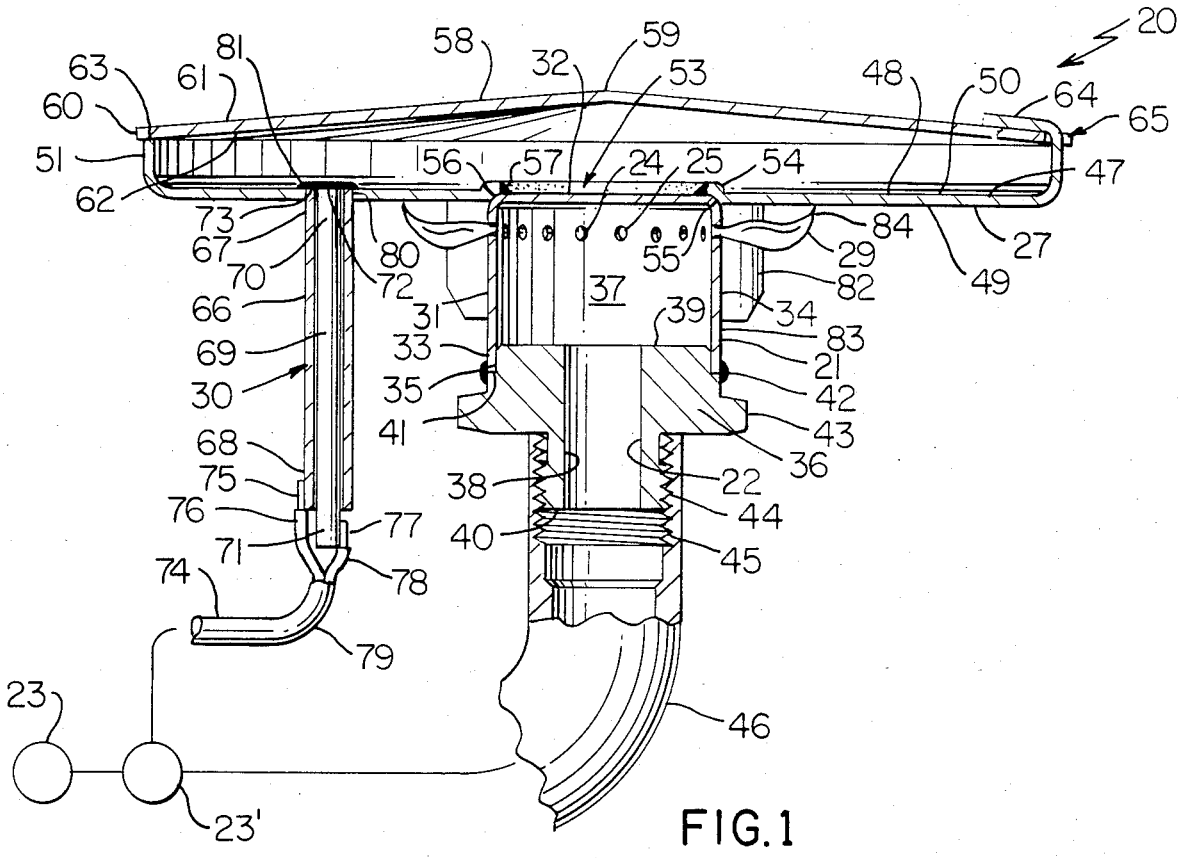
FIG. 1 is a fragmentary cross-sectional view illustrating one embodiment of the new dual rate burner construction of this invention while the same is operating with a standby rate of fuel flow thereto.

While the various features of this invention are hereinafter illustrated and described as being particularly adapted to provide a dual rate burner construction for providing the heating means for a water heater tank, it is to be understood that the various features of this invention can be utilized singly or in various combinations thereof to provide a dual rate burner construction for heating other devices as desired.

Therefore, this invention is not to be limited to only the embodiments illustrated in the drawings, because the drawings are merely utilized to illustrate one of the wide variety of uses of this invention.

Figure 2:
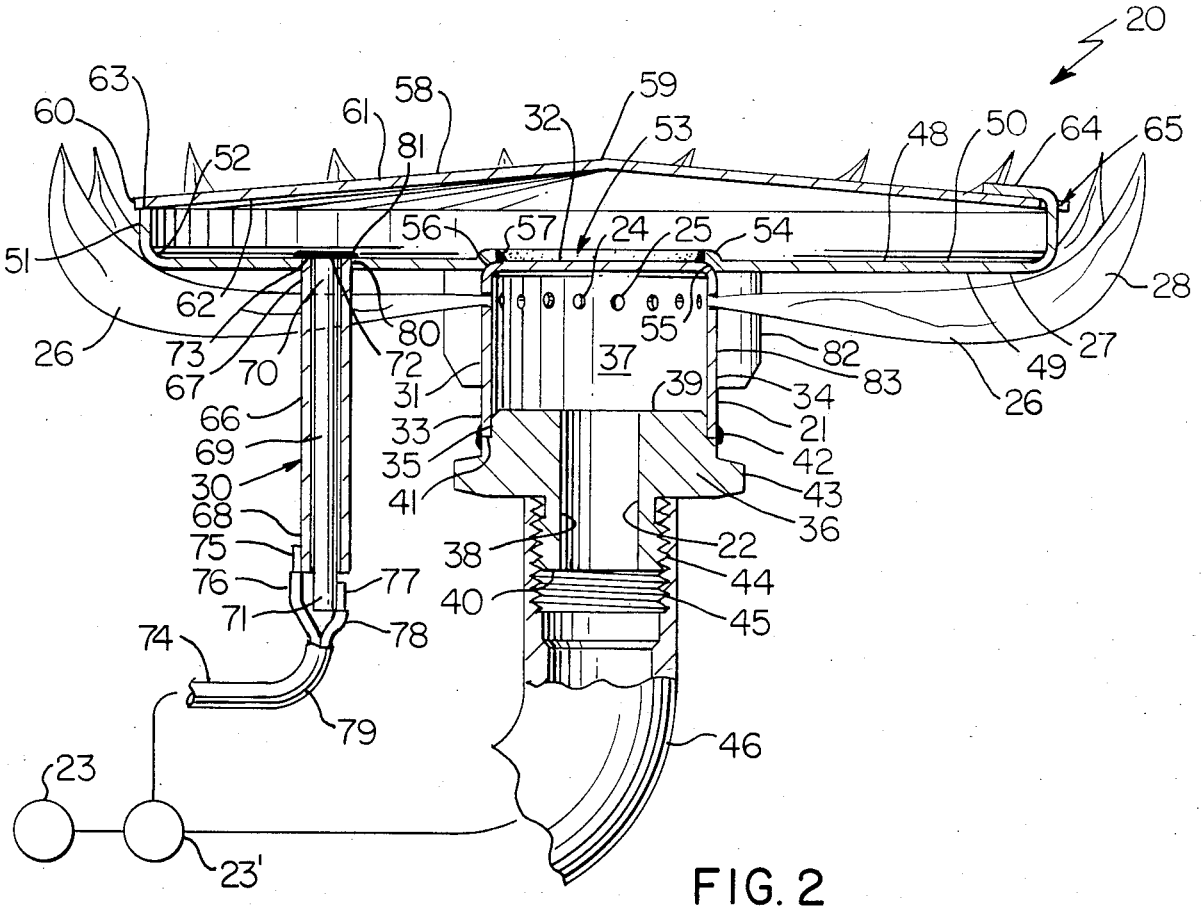
FIG. 2 is a view similar to FIG. 1 and illustrates the dual rate burner construction operating with a full rate of fuel flow thereto.

Referring now to FIGS. 1 and 2, one embodiment of the new dual rate burner construction of this invention is generally indicated by the reference numeral 20 and comprises a burner housing means 21 having inlet means 22 for receiving fuel from a source 23 thereof and outlet means 24, in the form of a plurality of burner ports 25, through which the fuel can issue to produce flame means 26 exterior to the burner housing means 21 when the issued fuel has been ignited as illustrated in FIGS. 1 and 2. The burner construction 20 further comprises a flame spreader means 27 carried by the burner housing means 21 in a manner hereinafter set forth for directing the flame means 26 into a desired heating pattern 28 thereof as illustrated in FIG. 2 for a heating purpose when the fuel is being directed into the inlet means 22 at a full rate of fuel thereof and for directing the flame means 26 into a desired standby pattern 29 thereof as illustrated in FIG. 1 when the fuel is being directed into the inlet means 22 at a standby rate of flow thereof. The burner construction 20 also comprises a flame sensing means or thermocouple that is generally indicated by the reference numeral 30 and is carried by the burner construction 20 for detecting the presence of the flame means 26 regardless of whether the flame means 26 are in the standby pattern 29 thereof as illustrated in FIG. 1 or in the heating pattern 28 of FIG. 2 as will be apparent hereinafter, the flame sensing means 30 of this invention being uniquely carried by the flame spreader means 27 in a spaced relation to the burner housing means 21.

The dual rate burner construction 20 of this invention is adapted to be utilized in the same manner as the dual rate burner construction disclosed in the aforementioned U.S. Pat. No. to Katchka et al, 3,998,582 whereby this patent is being incorporated into this disclosure by this reference thereto so that the structure of a control device 23' of FIGS. 1 and 2 for supplying fuel from the source 23 to the burner construction 20 of this invention need not be set forth nor the operation of the thermocouple 30 for causing the control device 23' to direct fuel from the source 23 to the burner construction 20 as long as the flame sensing means 30 is sensing the presence of the flame means 26 in a manner hereinafter set forth as such structure of the control device 23' and the electromagnetic operating means that receives the electrical signal from the thermocouple means 30 is fully set forth and described in the aforementioned U.S. Pat. No. to Katchka et al, 3,998,582.

Therefore, only the details on the burner construction 20 of this invention as illustrated in the drawings need be described in order to fully understand the operation of the burner construction 20 of this invention.

The burner housing means 21 comprises a cup-shaped housing member 31 having a substantially flat end wall 32 and an open end 33 disposed at the free end of a substantially cylindrical side wall means 34 thereof. The open end 33 of the cup-shaped housing member 31 is telescoped over an annular shoulder 35 of an adapter member 36 that forms part of the housing means 21 and closes off the open end 33 of the housing member 31 to define a chamber 37 therein, the adapter member 36 having an opening 38 passing between the opposed ends 39 and 40 thereof and defining the inlet means 22 for the housing means 21 that leads to the chamber 37 thereof.

While the housing members 31 and 36 can be formed of any suitable material, the same can be formed of metallic material, such as stainless steel, and the open end 33 of the cup-shaped member 31 can abut against another annular shoulder 41 on the adapter member 36 and be welded thereto by the weld means 42 as illustrated whereby the housing members 31 and 36 are secured together by the weld means 42.

However, it is to be understood that the cup-shaped housing member 31 could be uniquely secured to the adapter member 36 merely by a rolling operation on the open end 33 of the cup-shaped housing member 31 that deforms the same into an annular groove formed in the adapter member 36 as fully illustrated and described in the copending patent application of J. R. Katchka, Ser. No. 769,548, filed Aug. 23, 1985, whereby this copending patent application is being incorporated into this disclosure by this reference thereto.

The adapter member 36 of the housing means 21 has an annular hex-shaped flange 43 for facilitating the threading of an externally threaded section 44 of the adapter member 36 into an internally threaded end 45 of a conduit means 46 that is adapted to direct fuel from the control device 23' that is disposed between the fuel source 23 and the burner construction 20 as set forth in the aforementioned U.S. Pat. No. to Katchka et al, 3,998,582 to the inlet means 22 of the burner construction 20.

Figure 3:
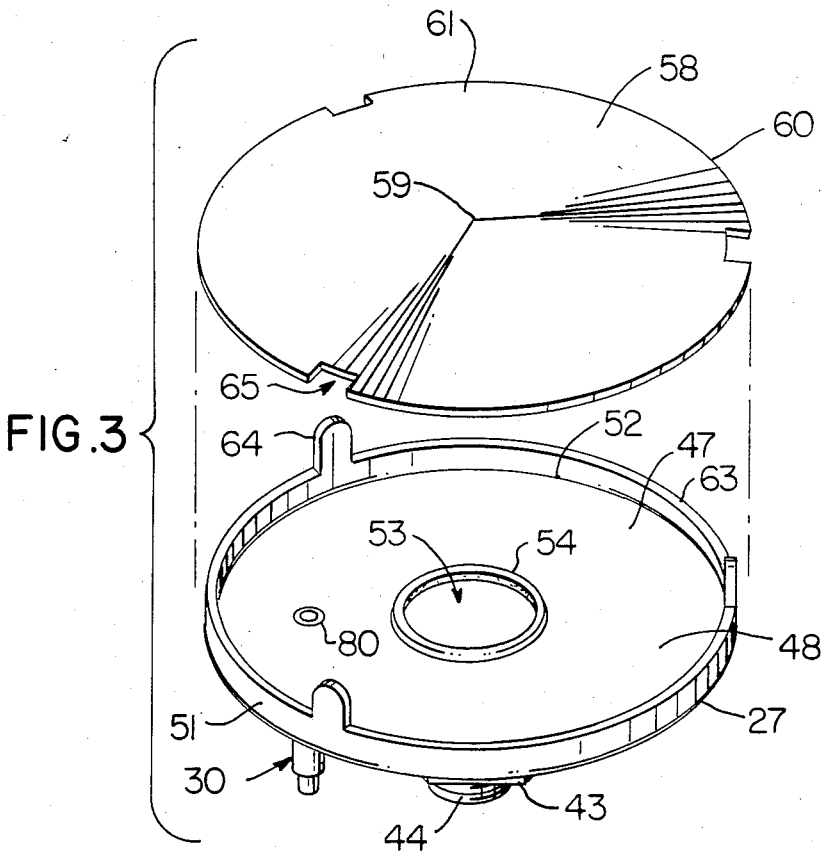
FIG. 3 is an exploded perspective view of certain parts of the flame spreader means of the burner construction of FIGS. 1 and 2.

The flame spreader means 27 of the burner construction 20 of this invention is formed of a cup-shaped metallic member 47 formed of any suitable metallic material, such as stainless steel, and has a substantially flat wall 48 provided with opposed sides 49 and 50, the wall 48 being substantially circular and having an upstanding annular flange 51 at the outer periphery 52 thereof as best illustrated in FIG. 3.

The wall 48 of the flame spreader means 27 has a central opening 53 passing therethrough and defining an upturned annular flange 54 that is provided with an annular groove 55 on the side 49 thereof that is adapted to nest on an external annular convex surface 56 of the housing member 31 that is disposed between the flat end wall 32 and annular cylindrical side wall 34 thereof as illustrated in FIGS. 1 and 2, the flame spreader means 27 being secured to the burner housing means 21 in any suitable manner, such as by being welded thereto by the weld means 57 as illustrated in FIGS. 1 and 2 whereby it can be seen that the flame spreader means 27 is carried by the burner housing means 21 in such a manner that the wall means 48 is annular and extends outwardly from around the burner housing means 21 to control the flame means 26 in a manner hereinafter set forth and as illustrated in FIGS. 1 and 2.

The flame spreader means 27 includes a drip shield 58 that is substantially conical in shape by having an apex 59 substantially at the center thereof and an outer peripheral and circular edge means 60 so as to define a convex side 61 thereof and a concave side 62 thereof, the drip shield or plate 58 being formed of any suitable metallic material, such as stainless steel and being secured to the wall means 48 in any suitable manner.

For example, the drip shield 58 is secured to the member 47 by having the outer peripheral edge 60 thereof extend slightly beyond the annular flange 51 of the wall means 48 so that an upper surface 63 of the annular flange 51 of the wall means 48 engages against the side 62 of the drip shield 58 slightly inboard of the peripheral edge means 60 thereof and is formed with a plurality of projections or tongues 64 that are adapted to pass through aligned notches 65 formed through the drip shield 58 and be folded over the same against the outer surface 61 thereof as illustrated in FIGS. 1 and 2 to fasten the drip shield 58 to the wall means 48 for the purpose of directing any water or the like that should fall on the shield 58 outwardly to the peripheral edge means 60 thereof to protect the burner construction 20 in a manner well known in the art.

As previously stated, the flame sensing means 30 is a thermocouple unit that comprises an outer tubular member 66 having opposed ends 67 and 68 and an inner rod 69 disposed within the tubular member 66 and having opposed ends 70 and 71, the thermocouple tube 66 being formed of stainless steel and the thermocouple rod 69 being Copel as is well known in the art. The thermocouple rod 69 has its end 70 secured to the end 67 of the surrounding thermocouple tube 66 by a welding of the end surfaces 72 and 73 with weld means (not shown) so that the end surfaces 72 and 73 are substantially flush as illustrated in FIGS. 1 and 2. Such welding of the end surfaces 72 and 73 can be made by arc welding using a tungsten electrode with an inert gas.

The rod 69 of the thermocouple unit 30 has its end 71 extending beyond the end 68 of the thermocouple tube 66 as illustrated in FIGS. 1 and 2 so that a two wire lead means 74 for the thermocouple unit 30 has a bared end 75 of an insulated wire 76 electrically secured thereto, such as by soldering, brazing, welding or the like, while another bared end 77 of another insulated wire 78 of the thermocouple wire 74 is electrically secured to the end 71 of the thermocouple tube 69 by soldering, brazing, welding, or the like, the two insulated wires 76 and 78 being carried inside an insulating means 79 in a manner well known in the art.

In this manner, the heating of the thermocouple unit 30 by the flame means 26 of the burner construction 20 of this invention in a manner hereinafter set forth will cause the thermocouple unit 30 to generate an electrical signal in a manner well known in the art to be directed by the wire means 74 to the control device 23' that controls the operation of the burner construction 20 in the manner fully set forth in the aforementioned U.S. Pat. No. to Katchka et al, 3,998,582 whereby as long as the flame means 26 exist at the burner construction 20, the control device 23' will either be directing the standby flow of fuel as illustrated in FIG. 1 to the burner construction 20 or will be directing the full flow of fuel as illustrated in FIG. 2.

The thermocouple unit 30 is secured to the flame spreader means 27 by having the ends 70 and 67 of the rod means 69 and tubular member 66 telescoped into a substantially cylindrical opening 80 formed through the wall means 48 so that the end edges 72 and 73 of the rod 69 and tubular member 66 are disposed substantially flush with the upper surface 50 of the wall means 48 as illustrated in FIGS. 1 and 2, the thermocouple unit 30 then being secured in such opening means 80 by having the tubular member 66 welded to the upper surface 50 of the wall means 48 as well as to the rod means 69 by the weld means 81 as illustrated.

The welding of the thermocouple unit 30 to the wall means 48 of the flame spreader means 27, as well as the weld means 57 for securing the wall means 48 to the burner housing member 31 and the weld means 42 for securing the housing member 31 to the housing member 36 can all also be formed by an arc welding operation using a tungsten electrode with an inert gas.

If desired, the flame spreader means 27 can have draft shield tabs 82 extending from the side 49 of the wall means 48 to be disposed closely adjacent the outside surface 83 of the side wall means 34 of the housing member 31 as illustrated, the tabs 82 being circumferentially spaced from each other and being any desired number within a practical limit.

If such draft tabs 82 are utilized, the burner ports 25 through the housing member 31 while normally being equally spaced from each other in a circumferential direction about the side wall means 34 could be so arranged that no burner port 25 will be adjacent a draft tab 82 or the spacing between adjacent burner ports 25 could be greater wherever a draft tab 82 is located so that each draft tab 82 does not cover a burner port 25.

From the above, it can readily be seen that the new dual rate burner construction 20 of this invention can be formed in a relatively simple manner from the parts thereof by the method of this invention as previously described to operate in a manner now to be described.

When the burner construction 20 has been mounted by suitable support means (not shown) beneath a water heater tank or the like (not shown) in a conventional manner and a suitable thermostatically operated control device 23' has been interconnected to the conduit means 46 and to the fuel source 23 in a conventional manner and the electrically or electromagnetically operated valve device of the control device 23' has been operated so that the initial flow of fuel to the burner construction has been ignited to form the flame means 26 in a manner well known in the art, the control device 23' will direct a gaseous flow of fuel from the source 23 through the conduit means 46 to the inlet means 22 of the burner housing means 21 at a relatively low standby rate of flow when the thermostatic means of such control device 23' is determining that the burner construction 20 should not be heating such water heater tank with a full rate of flow of fuel to the burner construction 20, such standby rate of flow of fuel to the burner construction 20 causing the fuel to issue out of the burner ports 25 at a rate that causes the flame means 26 to create the standby flame pattern 29 with the flame spreader means 27 so that the outer periphery 84 thereof is disposed about halfway between the sidewall means 34 of the housing member 31 and the thermocouple unit 30 as illustrated in FIG. 1. However, the heat of such flame means 26 in the standby pattern 29 thereof is sufficient to heat the wall means 48 in such a manner that the wall means 48 conducts the heat to the thermocouple unit 30 so that the thermocouple unit 30 generates an electrical signal which is sufficient to maintain the electrically operated valve means of the control device 23' in the "on" condition thereof so that the control device 23' will continue to supply a standby rate of flow of fuel to the burner construction 20 as previously described.

When the control device 23' determines that the burner construction 20 should be producing the heating flame pattern 28 of FIG. 2, the control device 23' directs a full rate of flow of fuel through the conduit means 46 to the inlet means 22 of the burner housing means 21 so that the full rate of flow of fuel that now issues out of the burner ports 25 creates the flame pattern 28 which is directed by the wall means 48 to extend out around the outer peripheral edge 65 of the annular flange 51 thereof as illustrated in FIG. 2 for the purpose of heating the water heater tank in a manner well known in the art, such flame pattern 28 of course directly impinging against the thermocouple unit 30 so that the same continues to direct an electrical signal to the control device indicating the presence of the flame means 26 and thereby maintaining the electrically operated valve means of the control device 23' in the "on" condition thereof so that the control device 23' will continue to supply the full rate of flow of fuel to the burner construction 20 as long as the thermostatic means of the control device 23' demands a full rate of fuel flow.

Of course, when the thermostatic means of the control device 23' determines that the full rate of flow should cease, the control device 23' again direct the standby rate of flow of fuel to the burner construction 20 so that the burner construction 20 again operates in the standby mode of operation thereof as illustrated in FIG. 1 as previously described.

Thus, as long as the control device 23' is either directing a standby rate of flow of fuel to the burner construction 20 as illustrated in FIG. 1 or is directing a full rate of flow of fuel thereto as illustrated in FIG. 2, the thermocouple unit 30 will detect the heat of the flame means 26 either through conduction as illustrated in FIG. 1 or through direct heating by the flame means 26 as illustrated in FIG. 2 so as to continuously supply the electrical current necessary to hold the electrically operated valve means of the control device 23' in an "on" condition thereof.

Of course, should the flame means 26 go out for any reason, the thermocouple unit 30 will no longer generate an electrical signal so that the electrically operated valve means of the control device 23' will close and terminate any flow of fuel to the burner construction 20 in a manner well known in the art.

Therefore, it can be seen that the new dual rate burner construction 20 of this invention readily permits the thermocouple means 30 thereof to be carried by the flame spreader means 27 in a spaced relation to the burner housing means 21 and still detect the presence of the flame means 26 regardless of whether the flame means 26 is in the small standby pattern 29 thereof or in the large heating pattern 28 thereof as previously described whereby the burner housing means 21 need not carry such thermocouple means 30 as is provided in the aforementioned U.S. Pat. No. to Katchka et al, 3,998,582 and the burner construction 20 will still operate in a fuel control system in substantially the same manner as the burner construction set forth in the aforementioned U.S. Pat. No. to Katchka et al, 3,998,582 for the heating purpose thereof or for other heating purposes as desired.

While the thermocouple means 30 of the dual rate burner construction 20 of this invention has been previously described as being secured to the flame spreader means 27 by the weld means 81, it is to be understood that the thermocouple means 30 can be secured to the flame spreader means 27 by other means and such other means can be detachable means so that the thermocouple means or unit 30 can be readily replaced in the field from the burner construction 20 without requiring a complete burner construction 20 to replace a burner construction 20 that has a malfunctioning thermocouple means 30.

Figure 4:
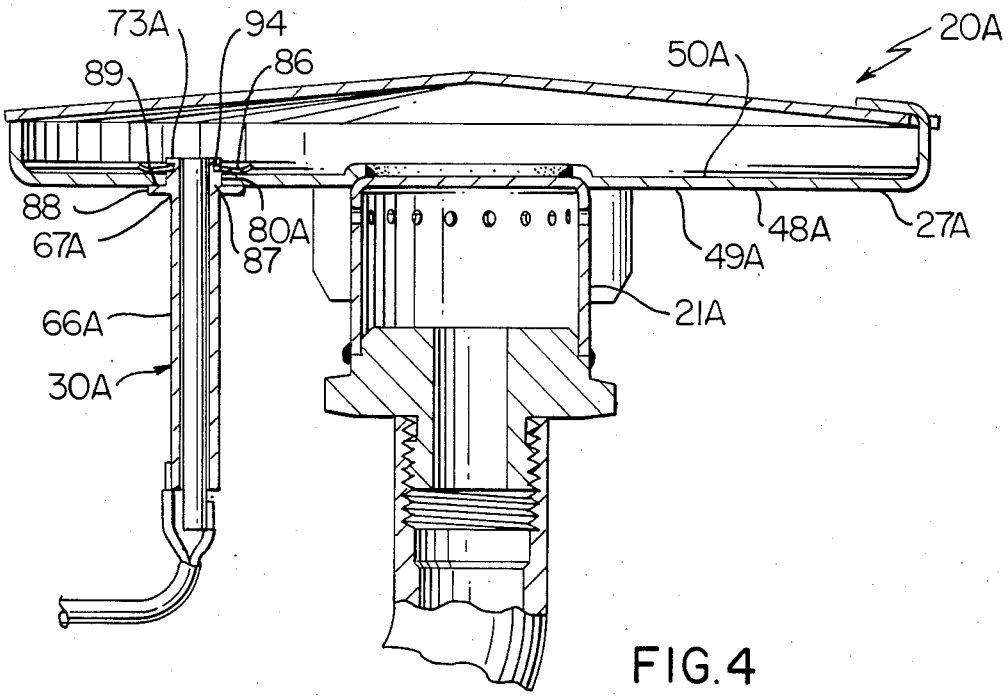
FIG. 4 is a view similar to FIG. 1 and illustrates another embodiment of the dual rate burner construction of this invention.

For example, such a burner construction having a readily replaceable thermocouple unit is generally indicated by the reference numeral 20A in FIG. 4 and the parts thereof that are similar to parts of the burner construction 20 previously described are indicated by like reference numerals followed by the reference letter "A".

Figure 5:
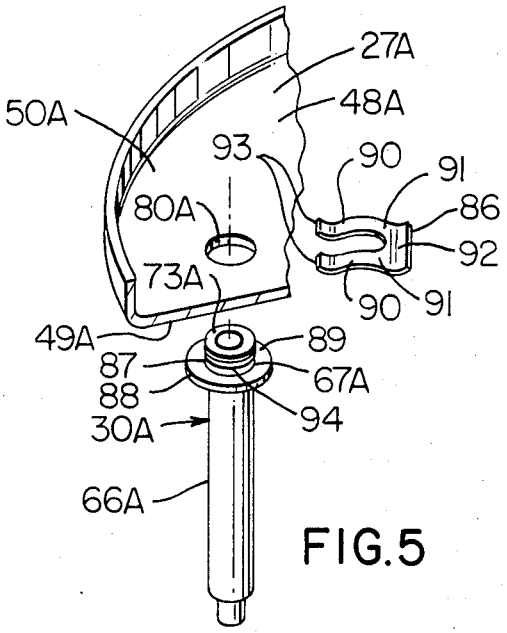
FIG. 5 is a fragmentary exploded perspective view illustrating how the flame sensing means of the burner construction of FIG. 4 is detachably secured to the flame spreader means thereof.
Figure 6:
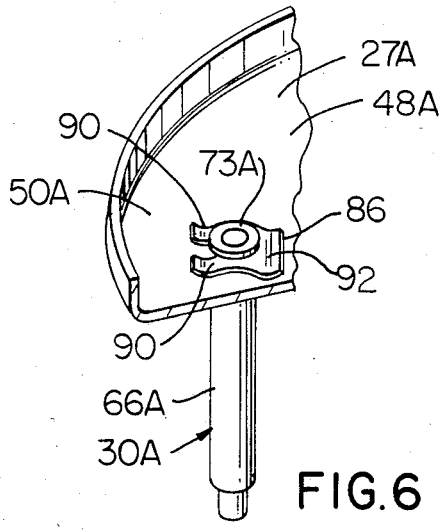
FIG. 6 is a view similar to FIG. 5 and illustrates the parts of FIG. 5 in the assembled condition thereof.

As illustrated in FIGS. 4, 5 and 6, the burner construction 20A is substantially the same as the burner construction 20 previously described except that the end 67A of the thermocouple tube 66A of the flame sensing means 30A is detachably secured in the opening means 80A of the wall means 48A of the flame spreader means 27A by a removable spring clip means 86 in a manner now to be described.

The tube 66A of the thermocouple unit 30A has an enlarged upper end section 87 provided with an outwardly extending annular flange 88 that has a surface 89 adapted to abut against the surface 49A of the wall means 48A when the end section 87 is telescoped into the opening 80A as illustrated in FIG. 4, the enlarged end section 87 having its end surface 73A extending beyond the upper surface 50A of the wall 48A as illustrated in FIG. 4 when the surface 89 of the annular flange 88 abuts against the surface 49A of the wall 48A as illustrated in FIGS. 4 and 6.

The clip 86 is formed from resilient metallic material and is substantially U-shaped to define a pair of spaced apart legs 90 joined together at adjacent ends 91 thereof by a cross section 92 while the other ends 93 thereof are free, the legs 90 being bowed so as to provide a spring force when the legs 90 are respectively slipped into an annular groove 94 formed in the enlarged end section 87 at a location therein that will be above the surface 50A of the wall 48A when the end section 87 is fully received in the opening 80A as illustrated in FIGS. 4 and 6 so that the legs 90 are caused to be straightened from their normal bowed condition to continuously exert a force that urges the surface 89 of the flange 88 into engagement with the surface 49A of the wall 48A in a manner well known in the spring clip art.

In this manner, it can be seen that the thermocouple unit 30A of the burner construction 20A of this invention is carried by the flame spreader means 27A in spaced relation to the burner housing means 21A by the detachable means 86 so that the detachable means 86 can be readily removed to permit the thermocouple unit 30A to be untelescoped from the opening 80A and have a new thermocouple unit 30A readily replaced therein by merely utilizing the fastening means 86 in the manner previously described.

However, the dual rate burner construction 20A functions in the same manner as the burner construction 20 previously described so that the operation thereof will not be repeated.

Figure 7:
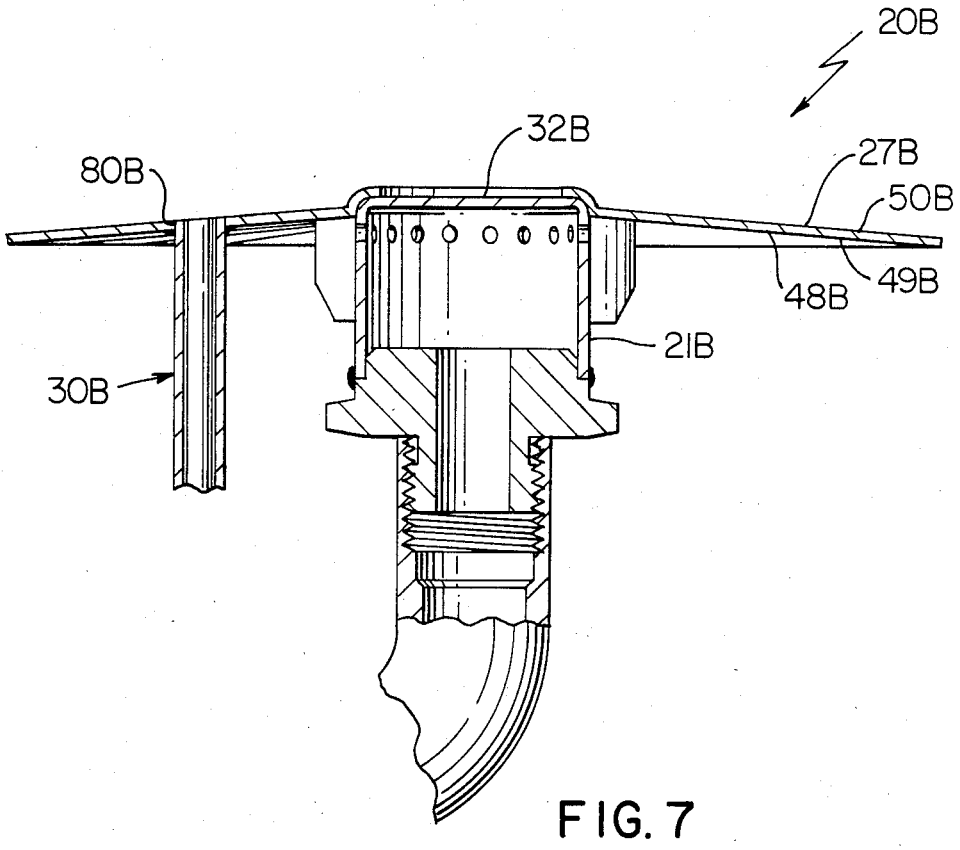
FIG. 7 is a view similar to FIG. 4 and illustrates another embodiment of the dual rate burner construction of this invention.

Another dual rate burner construction of this invention is generally indicated by the reference numeral 20B in FIG. 7 parts thereof similar to the dual rate burner construction 20 previously described are indicated by like reference numerals followed by the reference letter "B".

As illustrated in FIG. 7, the burner construction 20B is substantially the same as the burner construction 20 previously described except that the flame spreader means 27B thereof has a different shape and does not utilize a drip shield or plate 58 as previously described because the wall means 48B of the flame spreader means 27B is shaped to define a frusto-conical construction so that the upper surface 50B thereof slopes downwardly and away from the top wall 32B of the burner housing means 21B to act as a sloping surface in the same manner as the conical surface 61 of the drain shield or plate 58 previously described.

Thus, it can be seen that the wall means 48B of the flame spreader means 27B of the burner construction 20B has the surface 49B thereof be the concave side thereof while the side 50B is the convex side thereof, the wall means 48B carrying the thermocouple unit 30B in the opening 80B passing through the wall means 48B in the same manner as the thermocouple unit 30 previously described (or in the same manner of the thermocouple unit 30A) so that the thermocouple unit 30B is disposed spaced from the burner housing means 21B to operate in the same manner as the thermocouple unit 30 previously described.

Therefore, it can be seen that this invention not only provides new dual rate burner constructions but also this invention provides new methods of making such dual rate burner constructions.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a dual rate burner construction comprising a burner housing means having inlet means for receiving fuel from a source thereof and outlet means through which said fuel can issue to produce flame means exterior to said burner housing means when said issued fuel has been ignited, a flame spreader means carried by said burner housing means for spreading said flame means into a desired heating pattern thereof for a heating purpose when said fuel is being directed into said inlet means at a full rate of flow thereof and for directing said flame means into a desired standby pattern thereof when said fuel is being directed into said inlet means at a standby rate of flow thereof, and a flame sensing means carried by said construction for detecting the presence of said flame means, the improvement wherein said flame sensing means is carried by said flame spreader means in a spaced relation to said burner housing means.

2. A dual rate burner construction as set forth in claim 1 wherein said flame sensing means senses the heat produced by said flame means.

3. A dual rate burner construction as set forth in claim 2 wherein said flame sensing means comprises a thermocouple means.

4. A dual rate burner construction as set forth in claim 2 wherein said flame sensing means is carried by said flame spreader means in spaced relation from said standby pattern of said flame means, said flame spreader means being formed of heat conductive material and thereby being adapted to conduct heat from said standby pattern of said flame means to said flame sensing means so as to be detected thereby.

5. A dual rate burner construction as set forth in claim 4 wherein said flame spreader means has an annular wall means extending outwardly from around said burner housing means and having opposed sides, said wall means having an opening means passing through said opposed sides thereof and receiving part of said flame sensing means therein, and means securing said part of said flame sensing means in said opening means of said wall means so that said flame sensing means is carried by said flame spreader means.

6. A dual rate burner construction as set forth in claim 5 wherein said means securing said part of said flame sensing means in said opening means of said wall means comprises weld means.

7. A dual rate burner construction as set forth in claim 5 wherein said means securing said part of said flame sensing means in said opening means of said wall means comprises detachable means so that said flame sensing means can be readily detached from said wall means.

8. A dual rate burner construction as set forth in claim 7 wherein said flame sensing means has a free end extending beyond one of said sides of said wall means, said detachable means being detachably secured to said free end of said flame sensing means.

9. A dual rate burner construction as set forth in claim 8 wherein said flame sensing means has an abutment means that abuts against the other of said sides of said wall means.

10. A dual rate burner construction as set forth in claim 9 wherein said detachable means comprises a spring means that urges said abutment means into abutting relation with said other side of said wall means when said detachable means is secured to said free end of said flame sensing means.

11. In a method of making a dual rate burner construction comprising the steps of forming a burner housing means having inlet means for receiving fuel from a source thereof and outlet means through which said fuel can issue to produce flame means exterior to said burner housing means when said issued fuel has been ignited, forming a flame spreader means to be carried by said burner housing means for spreading said flame means into a desired heating pattern thereof for a heating purpose when said fuel is being directed into said inlet means at a full rate of flow thereof and for directing said flame means into a desired standby pattern thereof when said fuel is being directed into said inlet means at a standby rate of flow thereof, and forming a flame sensing means to be carried by said construction for detecting the presence of said flame means, the improvement comprising the step of disposing said flame sensing means so as to be carried by said flame spreader means in a spaced relation to said burner housing means.

12. A method of making a dual rate burner construction as set forth in claim 11 and including the step of forming said flame sensing means to be adapted to sense the heat produced by said flame means.

13. A dual rate burner construction as set forth in claim 12 and including the step of forming said flame sensing means to comprise a thermocouple means.

14. A method of making a dual rate burner construction as set forth in claim 12 and including the steps of disposing said flame sensing means to be carried by said flame spreader means in spaced relation from said standby pattern of said flame means, and forming said flame spreader means to be formed of heat conductive material and thereby be adapted to conduct heat from said standby pattern of said flame means to said flame sensing means so as to be detected thereby.

15. A method of making a dual rate burner construction as set forth in claim 14 and including the steps of forming said flame spreader means to have an annular wall means extending outwardly from around said burner housing means and having opposed sides, forming said wall means to have an opening means passing through said opposed sides thereof, disposing part of said flame sensing means in said opening means, and securing said part of said flame sensing means in said opening means of said wall means with securing means so that said flame sensing means is carried by said flame spreader means.

16. A method of making a dual rate burner construction as set forth in claim 15 wherein the step of securing said part of said flame sensing means in said opening means of said wall means comprises welding said flame sensing means to said wall means with weld means.

17. A method of making a dual rate burner construction as set forth in claim 15 and including the step of forming said means that secures said part of said flame sensing means in said opening means of said wall means to comprise detachable means so that said flame sensing means can be readily detached from said wall means.

18. A method of making a dual rate burner construction as set forth in claim 17 and including the steps of forming said flame sensing means to have a free end extending beyond one of said sides of said wall means, and forming said detachable means to be detachably secured to said free end of said flame sensing means.

19. A method of making a dual rate burner construction as set forth in claim 18 and including the step of forming said flame sensing means to have an abutment means that abuts against the other of said sides of said wall means.

20. A method of making a dual rate burner construction as set forth in claim 19 and including the stop of forming said detachable means to comprise a spring means that urges said abutment means into abutting relation with said other side of said wall means when said detachable means is secured to said free end of said flame sensing means.

* * * * *